US005699963A

United States Patent [19]

Ueda

[11] Patent Number: 5,699,963

[45] Date of Patent: Dec. 23, 1997

[54] ELECTROMAGNETIC VALVE AND UNIT-TYPE FUEL INJECTION DEVICE USING THE SAME

[75] Inventor: Atsushi Ueda, Higashimatsuyama, Japan

[73] Assignee: Zexel Corporation, Tokyo, Japan

[21] Appl. No.: 494,266

[22] Filed: Jun. 23, 1995

[30] Foreign Application Priority Data

Jul. 6, 1994 [JP] Japan ..... 6-177493

[51] Int. Cl.[6] ..... F02M 51/00

[52] U.S. Cl. ..... 239/88; 239/586.3; 239/585.1

[58] Field of Search ..... 239/585.1, 585.3, 239/584, 88, 585.4; 123/446

[56] References Cited

U.S. PATENT DOCUMENTS 4,482,094 11/1984 Knape ..... 239/585.1 X

*Primary Examiner*—Lesley D. Morris

*Attorney, Agent, or Firm*—Darby & Darby

[57] ABSTRACT

An unit-type fuel injection device including a plunger for pressurizing fuel in a fuel pressurizing chamber, an injection nozzle which has a fuel reservoir and serves to inject the fuel pressurized in the fuel pressurizing chamber, and an electromagnetic valve which has a valve plug and serves to intercept fuel supply to the fuel pressurizing chamber, wherein the valve plug of the electromagnetic valve is provided with an intercommunication hole through which the fuel pressurizing chamber and the fuel reservoir of the injection nozzle intercommunicate with each other when the valve plug intercepts the fuel supply to the fuel pressurizing chamber.

15 Claims, 3 Drawing Sheets

ELECTROMAGNETIC VALVE AND UNIT-TYPE FUEL INJECTION DEVICE USING THE SAME

BACKGROUND OF THE INVENTION

1. Field of the Invention

The present invention relates to an electromagnetic valve, and an unit-type fuel injection device using the same.

2. Description of Related Art

There has been hitherto known an unit-type fuel injection device in which a plunger for pressurizing fuel in a fuel pressurizing chamber, an injection nozzle for injecting the fuel which is pressurized by the plunger, and an electromagnetic valve which can selectively intercept fuel supply to the fuel pressurizing chamber, are integrally formed into one body (for example, as disclosed in Japanese Laid-open Patent Application No. Hei-2-286868).

This unit-type fuel injection device has been more frequently utilized because it needs no injection pipe and thus the dead space of the device can be reduced by a volume corresponding to the injection pipe, so that fuel can be pressurized at a higher pressure.

However, in the conventional unit-type fuel injection device as described above, a fuel pressure feed passage (intercommunication hole) must be provided at the external side of the electromagnetic valve when the plunger, the electromagnetic valve and the injection nozzle are arranged along the same axial line. Accordingly, there occurs a problem that the dead space of the device is increased by a volume corresponding to the fuel pressure feed passage.

Furthermore, when a valve plug of the electromagnetic valve is opened, the fuel which is supplied to the fuel pressurizing chamber is filled in the neighborhood of a coil of the electromagnetic valve, and thus the coil is liable to be corroded by the fuel, so that durability of the electromagnetic valve itself is reduced.

SUMMARY OF THE INVENTION

An object of the present invention is to provide an electromagnetic valve and an unit-type fuel injection device using the electromagnetic valve, which are capable of reducing the dead space of the device, improving durability of the electromagnetic valve and improving a fuel injection cutting (stopping) sharpness.

In order to attain the above object, according to a first aspect of the present invention, an electromagnetic valve includes a fluid reservoir which intercommunicates with a fluid supply hole and a fluid return hole, and a valve plug which is provided in the fluid reservoir and serves to intercept intercommunication between the fluid reservoir and a first chamber, wherein the valve plug is provided with an intercommunication hole through which the first chamber and a second chamber intercommunicate with each other when the valve plug intercepts the intercommunication between the fluid reservoir and the first chamber.

According to a second aspect of the present invention, an unit-type fuel injection device includes a plunger for pressurizing fuel in a fuel pressurizing chamber, an injection nozzle which has a fuel reservoir and serves to inject the fuel pressurized in the fuel pressurizing chamber, and an electromagnetic valve which has a valve plug and serves to intercept fuel supply to the fuel pressurizing chamber, wherein the valve plug of the electromagnetic valve is provided with an intercommunication hole through which the fuel pressurizing chamber and the fuel reservoir of the injection nozzle intercommunicate with each other when the valve plug intercepts the fuel supply to the fuel pressurizing chamber.

In the unit-type fuel injection device as described above, the plunger, the injection nozzle and the electromagnetic valve are arranged along the same axis.

According to the first aspect of the present invention, when the valve plug is opened, the fluid supply hole, the fluid return hole and the first chamber intercommunicate with one another through the fluid reservoir, so that fluid is supplied from the fluid supply hole to the first chamber. On the other hand, when the valve plug is closed, the intercommunication between the fluid reservoir and the first chamber are intercepted, and the first chamber and a second chamber intercommunicates with each other, so that fluid in the first chamber is supplied to the second chamber. That is, a compact electromagnetic valve can be provided by providing the intercommunication hole to the valve plug.

According to the second aspect of the present invention, when the valve plug is opened, the fuel is supplied to the fuel pressurizing chamber, and then when the valve plug is closed, the fuel which is pressurized in the fuel pressurizing chamber by the plunger is supplied to the fuel reservoir of the injection nozzle through the intercommunication hole to inject the fuel from an injection hole of the injection nozzle.

DETAILED DESCRIPTION OF THE PREFERRED EMBODIMENT

A preferred embodiment according to the present invention will be described hereunder with reference to the accompanying drawings.

Figure 1:
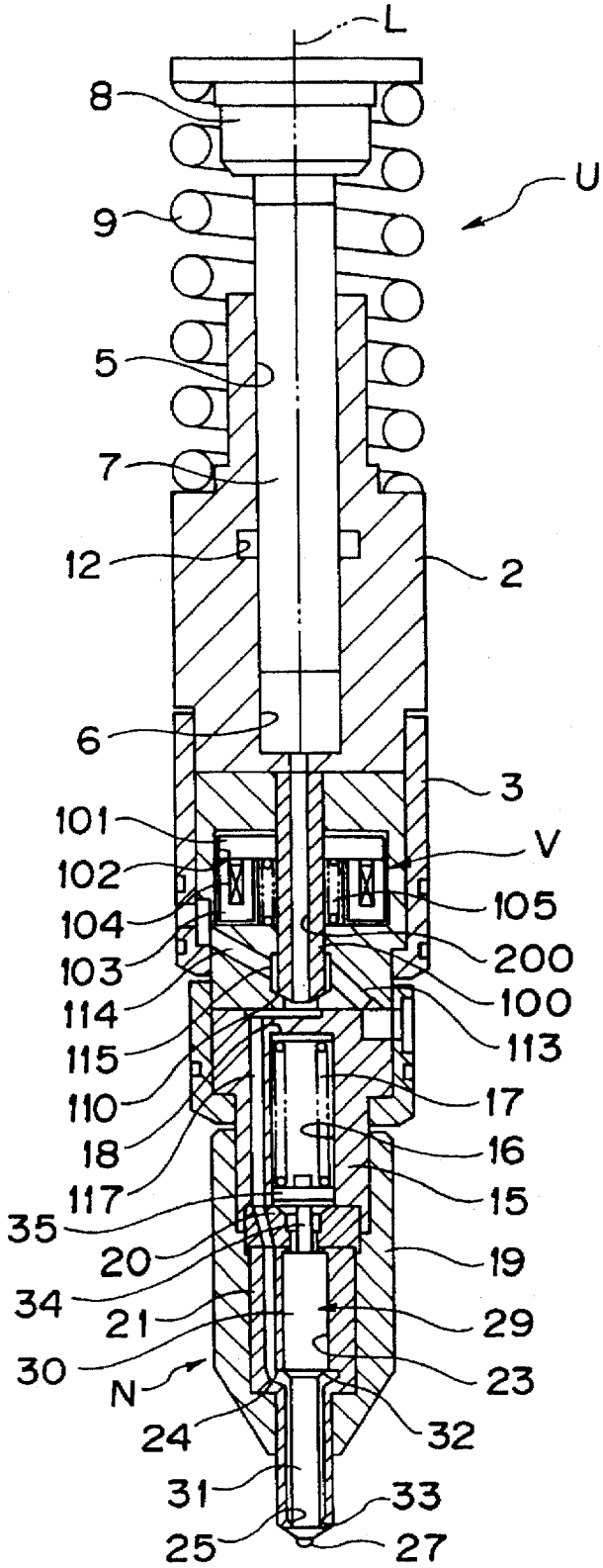
FIG. 1 is a longitudinally sectional view of an embodiment of the present invention.

FIG. 1 is a longitudinally sectional view of an embodiment of the present invention. In FIG. 1, U represents an unit-type fuel injection device, and it comprises an upper body portion 2 and a lower body portion 3 which is spirally engaged with the lower end portion of the upper body portion 2 while the axial lines L of the upper and lower body portions 2 and 3 are coincident with each other.

A plunger accommodating hole 5 and a fuel pressurizing chamber 6 are formed in the upper body portion 2 while the axial lines thereof are coincident with the axial line L. A plunger for pressurizing fuel which is introduced in the fuel pressurizing chamber 6 is inserted in the plunger accommodating hole 5 so as to be freely slidable along the hole 5. The upper end portion of the plunger 7 is linked to a follow member 8 which is upwardly and downwardly movable together with the plunger 7. A spring 9 for urging the follow member 8 upwardly is interposed between the follow member 8 and the upper body portion 2, and the upper end surface of the follow member 8 is pressed against a cam portion of a cam shaft (not shown) while contacted with the cam portion.

In the unit-type fuel injection device thus constructed, upon rotation of the cam shaft, the follow member 8 and the plunger 7 are integrally moved upwardly and downwardly while following the rotational motion of the cam shaft. For example, when the plunger 7 is moved downwardly, the fuel in the fuel pressurizing chamber 6 is pressurized. On the other hand, when the plunger 7 is moved upwardly, the fuel is introduced into the fuel pressurizing chamber 6. Furthermore, in order to prevent the fuel pressurized in the fuel pressurizing chamber 6 from leaking through a gap between the plunger accommodating hole 5 and the plunger 7 to the outside of the fuel injection device U, a ring-shaped groove 12 which extends along the peripheral direction of the plunger accommodating hole 5 is formed on the inner peripheral surface in the middle of the plunger accommodating hole 5, and the fuel which is trapped in the ring-shaped groove 12 is returned to a fuel chamber.

An electromagnetic valve V, which is the main feature of the present invention, is provided in the lower body portion 3. The characteristic of the electromagnetic valve V will be suitably described in the following detailed description on the unit-type fuel injection device U.

The electromagnetic valve V contains a needle valve plug 100 having therein an intercommunication hole 200 which is formed so as to be penetrated along a vertical (longitudinal) direction in the lower body portion 3, and a ring-shaped armature 101 is fixed on the ring-shaped outer periphery of the needle valve plug 100. The armature 101 is accommodated in the electromagnetic valve accommodating hole 102, and a stator coil 104 covered with a resin case 103 and a coil spring 105 for urging the armature 101 upwardly are accommodated in the electromagnetic valve accommodating hole 102 so as to be confronted with the armature 101.

Figure 2:
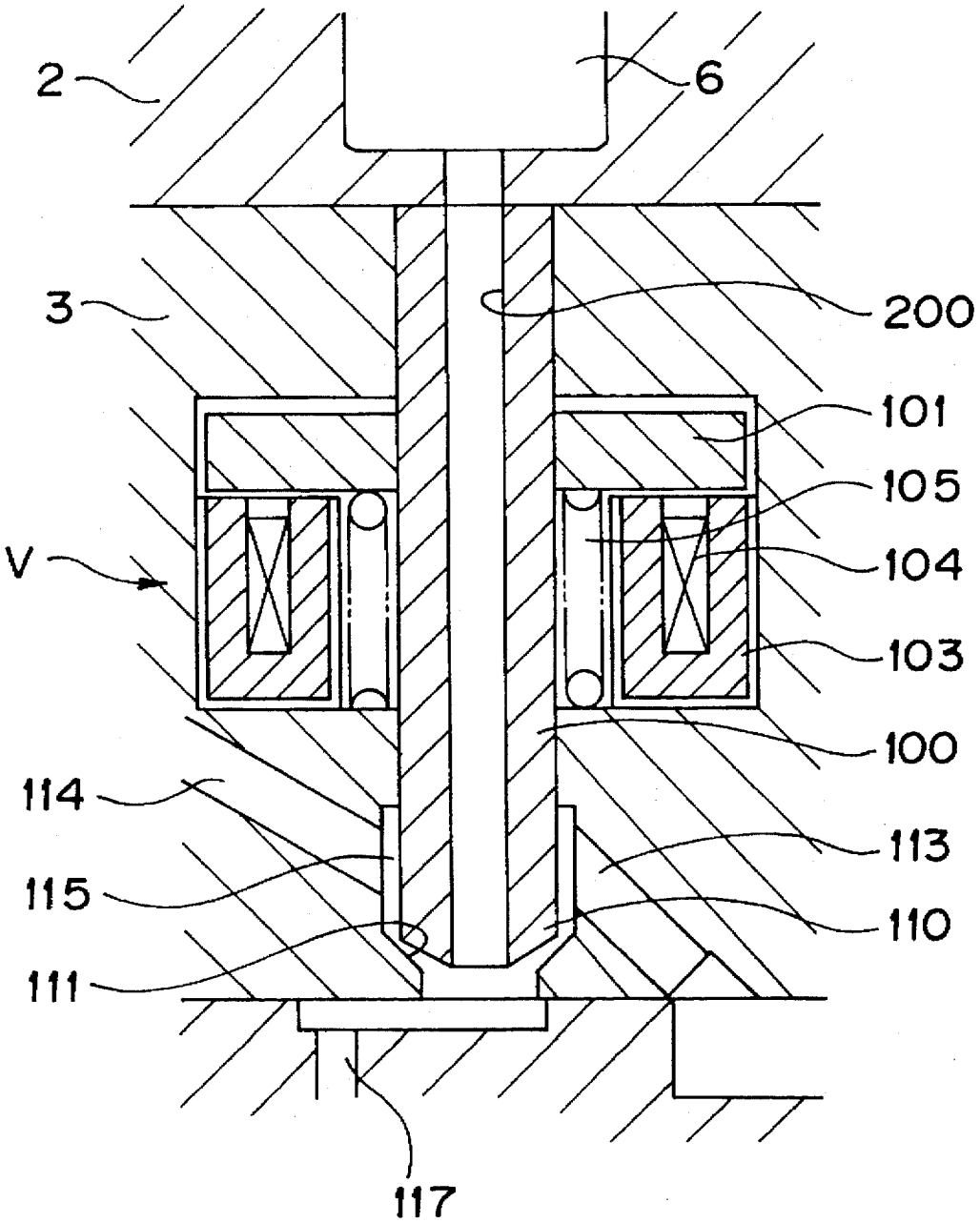
FIG. 2 is a cross-sectional view showing a state where a valve plug of an electromagnetic valve is opened.
Figure 3:
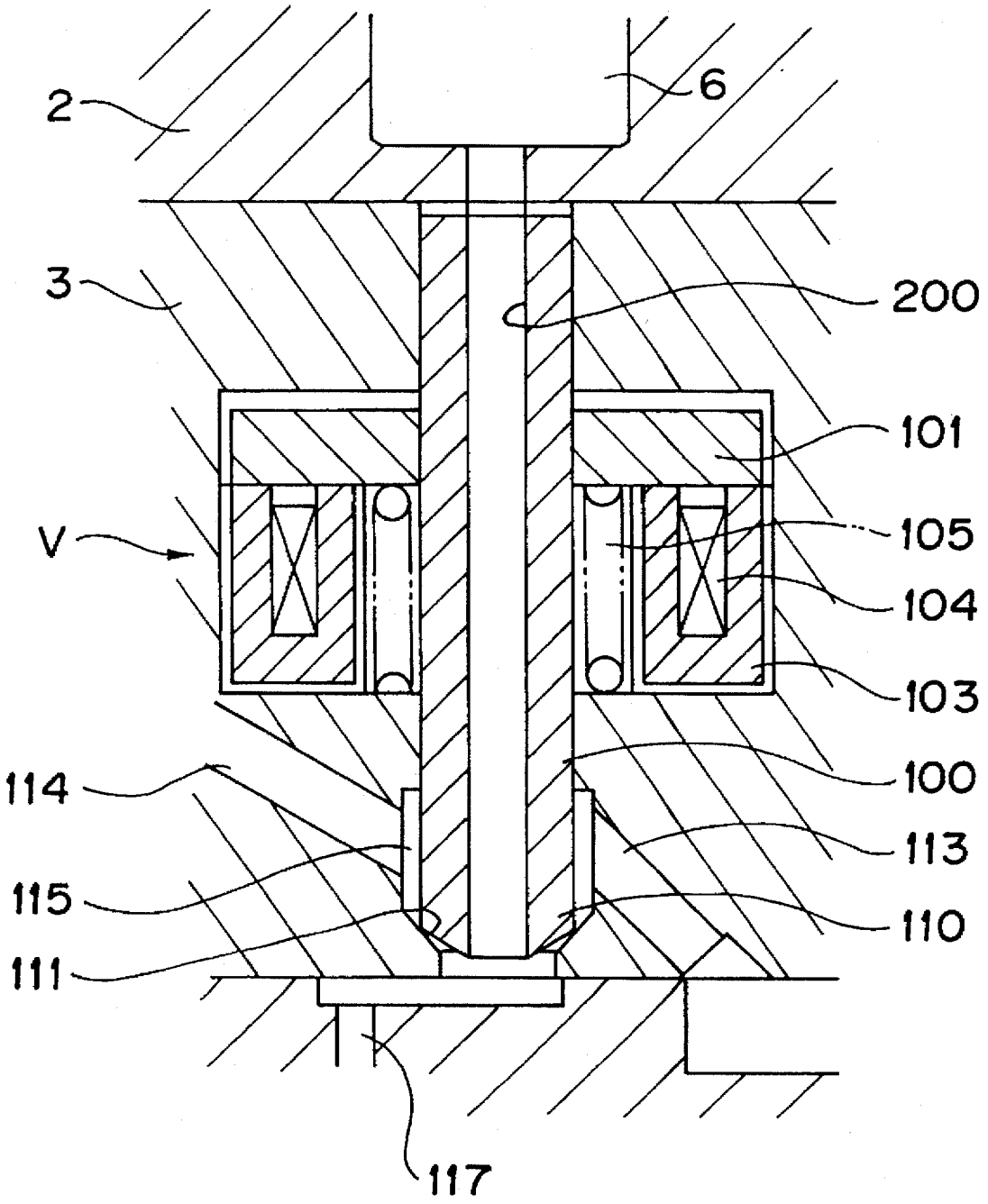
FIG. 3 is a cross-sectional view showing a state where the valve plug of the electromagnetic valve is closed.

A sheet portion 110 is provided at the lower end of the needle valve plug 100. As shown in FIG. 2, when the needle valve plug 100 is moved upwardly, the sheet portion 110 is separated from a valve seat portion 111 (valve opening operation). On the other hand, as shown in FIG. 3, when the needle valve plug 100 is moved downwardly, the sheet portion 110 abuts against the valve seat 111 (valve closing operation).

A fluid reservoir (hereinafter referred to as "fuel chamber") 115 is provided around the sheet portion 110, and a supply hole for fuel (hereinafter referred to as "fuel supply hole") 113 and a return hole for fuel (hereinafter referred to as "fuel return hole") 114 intercommunicate with each other through the fuel chamber 115. When the valve opening operation is performed as shown in FIG. 2, the fuel supply hole 113, the fuel pressurizing chamber 6 and the fuel return hole 114 intercommunicate with one another through the fuel chamber 115, and all the fuel pressure thereof is reduced to a lower pressure. On the other hand, when the valve closing operation is performed as shown in FIG. 3, a passage which extends from the fuel supply hole 113 through the fuel chamber 115 to the fuel return hole 114 is intercepted or blocked from a passage which extends from the fuel pressurizing chamber (first chamber) 6 through the intercommunication hole 200 of the needle valve plug 100 to a high-pressure passage (second chamber) 117. When the fuel in the fuel pressurizing chamber 6 is pressurized by the plunger 7 in the above state, the fuel is introduced through the high-pressure passage 117 to an injection nozzle N as described later.

In this case, it is preferable that the electromagnetic valve accommodating hole 102 and the fuel chamber 115 are disposed away from each other as far as possible in a vertical direction. This is because the fuel accumulated in the fuel chamber 115 may be transmitted along a gap between the needle valve plug 100 and a slide hole therefor, so that it invades into the electromagnetic valve accommodating hole 102. Therefore, the stator coil 104 and the armature 101 are liable to be corroded.

The high-pressure passage 117 is provided in a spring holder 15, and a spring accommodating hole 16 is provided in the spring holder 15. A nozzle spring 17 for urging a needle valve 29 downwardly is provided in the spring accommodating hole 16, and the urging force of the nozzle spring 17 can be adjusted by varying the thickness of a spacer 18 which is disposed between the upper end portion of the nozzle spring 17 and the surface of the spring accommodating hole 16.

The fuel injection nozzle N is secured at the lower end portion of the spring holder 15. That is, a cylindrical nozzle holder 19 is provided at the lower end portion of the spring holder 15 while the axial line of the nozzle holder 19 is coincident with the axial line L, and a spacer 20 and a nozzle body 21 are inserted in this order from the upper end side to the lower end side of the nozzle holder 19.

When the nozzle holder 19 is screwed on the spring holder 15, the nozzle body 21 is pushed up by the nozzle holder 19, and thus the spacer 20 is pressed against the lower end surface of the spring holder 15. With this operation, the nozzle body 21 and the spacer 20 are held by the nozzle holder 19. The nozzle holder 19 is fixed to the spring holder 15 while holding the nozzle body 21 and the spacer 20.

A needle valve accommodating hole 23 is formed in the nozzle body 21 so as to extend along the axial line L from the upper side to the lower side of the device. Furthermore, a fuel reservoir 24 which intercommunicates with the high-pressure passage 117 is formed in the middle of the needle valve accommodating hole 23, and a valve seat 25 is formed at the lower side of the fuel reservoir 24. In addition, a well-known sack portion (not shown) which intercommunicates with the needle valve accommodating hole 23 through the valve seat 25 is formed at the lower end portion of the nozzle body 21, and an injection nozzle 27 is formed so as to extend from the sack portion to the outer peripheral surface of the lower end portion of the nozzle body 21.

The needle valve 29 is freely slidably inserted in the needle valve accommodating hole 23. The needle valve 29 includes a large-diameter portion 30 which is disposed at an upper end portion thereof and engagedly mounted at the upper end portion of the needle accommodating hole 23 so as to be freely slidable and liquid-tight, a small-diameter portion 31 which is disposed at a lower end portion thereof and designed at a smaller diameter than the needle valve accommodating hole 23, and a pressure receiving portion 32 which is formed between the large-diameter portion 30 and the small-diameter portion 31. A valve portion 33 is formed on the lower end surface of the needle valve 29. By allowing the valve portion 33 to sit on the valve seat 25, the valve portion 33 intercepts the intercommunication between the needle valve 23 and the sack portion.

Furthermore, a shaft portion 34 is formed at the end surface of the needle valve 29. The shaft portion 34 is projected into a through hole which is formed at the center portion of the spacer 20, and it is downwardly urged by the nozzle spring 17 through a spring bearing 35. The needle valve 29 sits on the needle seat 25 by the urging force of the nozzle spring 17.

Next, an operation of the unit-type fuel injection device of this embodiment will be described.

Referring to FIG. 3, when the needle valve plug 100 is downwardly moved, the sheet portion 110 abuts against the needle seat portion 111 of the lower body portion 3 (valve closing operation), and the fuel in the fuel pressurizing chamber 6 is pressurized by the plunger 7, so that the fuel is fed through the high-pressure passage 117 into the fuel reservoir 24 of the injection nozzle N under pressure. With this operation, the fuel press force acting on the pressure receiving portion 32 of the needle valve 29 is larger than the urging force of the nozzle spring 17, so that the needle valve 29 is lifted up until it abuts against the spacer 20. Accordingly, the fuel in the fuel reservoir 24 is passed through the gap between the small-diameter portion 31 of the needle valve 29 and the valve accommodating hole 23 and the gap between the valve portion 33 and the valve seat 25 to the sack portion, and finally injected into a combustion chamber of an engine.

Referring to FIG. 2, when the needle valve plug 100 is upwardly moved, the sheet portion 110 is separated from the valve seat portion 111 of the lower body portion 3 (valve opening operation), so that the fuel supply hole 113, the fuel pressurizing chamber 6 and the fuel return hole 114 intercommunicate with one another through the fuel chamber 115 and the fuel pressure in the fuel reservoir 24 of the injection nozzle N is reduced to a lower pressure through the high-pressure passage 117. Accordingly, the fuel press force acting on the pressure receiving portion 32 of the needle valve 29 is set to be smaller than the urging force of the nozzle spring 17, so that the needle valve 29 is moved to sit on the valve seat 25 by the urging force of the nozzle spring 17, thereby completing the fuel injection.

According to the embodiment, the following effects can be obtained.

(1) Since the needle valve plug 100 is provided with the intercommunication hole 200, an intercommunication hole (fuel pressure feed passage) which bypasses the valve plug 100 is not required to be formed at the external side of the needle valve plug 100. Therefore, as compared with the prior art, the shaft (outer) diameter of the fuel injection device U can be more reduced by an amount corresponding to the size of the intercommunication hole.

(2) Accordingly, the dead volume can be reduced, and thus a space when the engine is mounted can be also reduced.

(3) In the conventional fuel injection device in which a hole bypassing the needle valve plug 100 is provided, it is necessary to provide a bypass hole in the lower body portion 3. In this case, an eccentric work is required. However, it is needless to say that this embodiment requires no eccentric work.

(4) Since the electromagnetic valve accommodating hole 102 and the fuel chamber 115 are disposed away from each other in the vertical direction, the fuel stocked in the fuel chamber 115 is prevented from invading into the electromagnetic valve accommodating hole 102, and thus the stator coil 104 and the armature 101 can be protected from being corroded by the fuel, so that the durability of these elements can be improved.

(5) When the electromagnetic valve V is de-actuated, the needle valve plug 100 is upwardly moved and the fuel injection is finished, the fuel pressure acts to push up the needle valve plug 100. Therefore, the upward movement of the needle valve plug 100 is promoted, and the fuel injection cutting sharpness (spill rate) can be improved.

(6) Furthermore, since the plunger 7, the injection nozzle N and the valve plug 100 of the electromagnetic valve V are arranged on the same axial line, the shaft diameter of the fuel injection device U can be designed to be more slender. Accordingly, the dead volume can be more reduced, and thus the space when the engine is mounted can be more reduced.

The present invention is not limited to the above embodiment, and various modifications may be made without departing from the subject matter of the present invention.

For example, the above embodiment relates to the fuel injection device, however, the present invention may be applied to an electromagnetic valve itself. Accordingly, when an electromagnetic valve is embedded in a pipe system, it can be disposed without increasing the sectional area of a portion of the pipe system at which the electromagnetic valve is disposed. With respect to the electromagnetic valve V, it may be disposed to turn upside down.

As described above, according to the present invention, the intercommunication hole is formed in the valve plug of the electromagnetic valve, so that it is unnecessary to provide a hole bypassing the valve plug. Therefore, the dead volume of the device can be more reduced, and thus the space when the engine is mounted can be more reduced. In addition, the durability of the electromagnetic valve and the fuel injection cutting sharpness can be improved.

What is claimed is:

1. An electromagnetic valve including:

a fluid reservoir through which a fluid supply hole and a fluid return hole intercommunicate with each other; and a valve plug which is provided in said fluid reservoir and serves to block intercommunication between said fluid reservoir and a first chamber, wherein said valve plug is provided with an intercommunication hole therein through which said first chamber and a second chamber intercommunicate with each other when said valve plug blocks the intercommunication between said fluid reservoir and said first chamber.

2. An electromagnetic valve including:

an accommodating hole which houses at least a portion of said electromagnetic valve;

a fluid reservoir through which a fluid supply hole and a fluid return hole intercommunicate with each other; and a valve plug which is disposed in said fluid reservoir and serves to block intercommunication between said fluid reservoir and a first chamber, wherein said valve plug is provided with an intercommunication hole therein through which said first chamber and a second chamber intercommunicate with each other when said valve plug blocks the intercommunication between said fluid reservoir and said first chamber, and further wherein said fluid reservoir and said accommodating hole are positioned relative to each other such that at least one coil of said electromagnetic valve is kept substantially free of fuel.

3. The electromagnetic valve as claimed in claim 1 or 2, wherein said first chamber comprises a fuel pressurizing chamber and said second chamber comprises a high-pressure passage which is linked to a nozzle unit for fuel injection.

4. The electromagnetic valve as claimed in claim 3, wherein said intercommunication hole is formed so as to be penetrated through said valve plug while the axial line thereof is coincident with the axial line of said valve plug.

5. The electromagnetic valve as claimed in claim 1 or 2, wherein said intercommunication hole is formed so as to be penetrated through said valve plug while the axial line thereof is coincident with the axial line of said valve plug.

6. An electromagnetic valve as claimed in claim 1, wherein said valve plug is disposed in direct contact with said fluid reservoir.

7. An electromagnetic valve as claimed in claim 2, wherein said fluid reservoir and said accommodating hole are spaced vertically from each other.

8. An electromagnetic valve as claimed in claim 2, wherein said valve plug is disposed in direct contact with said fluid reservoir.

9. An unit-type fuel injection device having a fuel pressurizing chamber, including:

a plunger which pressurizes fuel in said fuel pressurizing chamber;

an injection nozzle which has a fuel reservoir and serves to inject the fuel pressurized in said fuel pressurizing chamber; and an electromagnetic valve which has a valve plug and serves to block fuel supply to said fuel pressurizing chamber, wherein said valve plug of said electromagnetic valve is disposed in said fuel reservoir, and is provided with an intercommunication hole therein through which said fuel pressurizing chamber and said fuel reservoir of said injection nozzle intercommunicate with each other when said valve plug blocks the fuel supply to said fuel pressurizing chamber.

10. The unit-type fuel injection device as claimed in claim 9, wherein said plunger, said injection nozzle and said electromagnetic valve are arranged along the same axial line.

11. An unit-type fuel injection device as claimed in claim 9, wherein said valve plug is disposed in direct contact with said fluid reservoir.

12. An electromagnetic valve including:

a fluid reservoir which intercommunicates with at least one fuel supply and return hole;

a first fuel chamber for pressurizing fuel; and a second fuel chamber for discharging the pressurized fuel; and a valve plug which is disposed in said fluid reservoir at one end portion thereof so as to be movable upwardly and downwardly and selectively allows said fluid reservoir and said first fuel chamber to intercommunicate with each other in accordance with the upward and downward movement thereof, wherein said valve plug has therein an intercommunication hole through which said first fuel chamber and said second fuel chamber intercommunicate with each other when the intercommunication between said fluid reservoir and said first fuel chamber is blocked by said upwardly and downwardly movably valve plug, and said intercommunication hole, said fluid reservoir and said second fuel chamber intercommunicate with one another at said one end portion of said valve plug.

13. The electromagnetic valve as claimed in claim 12, wherein said valve plug has a rod shape.

14. The electromagnetic valve as claimed in claim 12, wherein said valve plug is disposed to be surrounded by coils of said electromagnetic valve.

15. An electromagnetic valve as claimed in claim 12, wherein said valve plug is disposed in direct contact with said fluid reservoir.

* * * * *